US007266954B2

(12) United States Patent
Yamada

(10) Patent No.: US 7,266,954 B2
(45) Date of Patent: Sep. 11, 2007

(54) METHOD AND DEVICE FOR INSTALLING REFRIGERATOR

(75) Inventor: Shunji Yamada, Hadano (JP)

(73) Assignee: Sumitomo Heavy Industries, Ltd (JP)

( * ) Notice: Subject to any disclaimer, the term of this patent is extended or adjusted under 35 U.S.C. 154(b) by 213 days.

(21) Appl. No.: 10/539,043

(22) PCT Filed: Dec. 16, 2002

(86) PCT No.: PCT/JP02/13149

§ 371 (c)(1),
(2), (4) Date: Jun. 15, 2005

(87) PCT Pub. No.: WO2004/055452

PCT Pub. Date: Jul. 1, 2004

(65) Prior Publication Data

US 2006/0048522 A1 Mar. 9, 2006

(51) Int. Cl.
*F25B 1/00* (2006.01)

(52) U.S. Cl. ..... 62/115; 62/298

(58) Field of Classification Search ..... 62/47.1, 62/48.1, 54, 51.1, 295, 298, 259.2, 115, 332, 62/374

See application file for complete search history.

(56) References Cited

U.S. PATENT DOCUMENTS

| | | | | | |
|---|---|---|---|---|---|
| 4,223,540 | A | * | 9/1980 | Longsworth | 62/51.1 |
| 4,765,153 | A | * | 8/1988 | Wachi | 62/51.1 |
| 4,796,433 | A | * | 1/1989 | Bartlett | 62/47.1 |
| 4,888,956 | A | * | 12/1989 | le Roux Murray | 62/51.1 |
| 5,018,359 | A | * | 5/1991 | Horikawa et al. | 62/51.1 |
| 5,613,367 | A | * | 3/1997 | Chen | 62/47.1 |
| 5,936,499 | A | | 8/1999 | Eckels | |
| 6,029,458 | A | * | 2/2000 | Eckels | 62/47.1 |
| 6,144,274 | A | * | 11/2000 | Bischke et al. | 335/216 |
| 6,181,228 | B1 | * | 1/2001 | Laskaris et al. | 335/300 |
| 6,244,068 | B1 | * | 6/2001 | Nagaishi | 62/530 |

FOREIGN PATENT DOCUMENTS

| | | | | |
|---|---|---|---|---|
| JP | 63-38862 | A | | 2/1988 |
| JP | 07-28056 | B2 | | 3/1995 |
| JP | 08-200864 | A | | 8/1996 |
| JP | 10-38397 | A | * | 2/1998 |
| JP | 2000-283578 | A | | 10/2000 |
| JP | 2001-143922 | A | | 5/2001 |
| JP | 2001-194020 | A | | 7/2001 |

OTHER PUBLICATIONS

International Search Report mailed on Apr. 1, 2003.

* cited by examiner

*Primary Examiner*—Mohammad M. Ali
(74) *Attorney, Agent, or Firm*—Rader, Fishman & Grauer PLLC

(57) ABSTRACT

A partition member partitions off a cooling stage of a refrigerator from a refrigerant container, containing a refrigerant gas condensed by the cooling stage, of a cooling system, and a low melting point metal held in the partition member brings the cooling stage into thermally contact with the refrigerant container. This makes it possible to exchange only the broken refrigerator without stopping the operation of the cooling system.

13 Claims, 7 Drawing Sheets

METHOD AND DEVICE FOR INSTALLING REFRIGERATOR

TECHNICAL FIELD

The present invention relates to a method for attaching a refrigerator and an attachment device thereof, by which a cooling stage of the refrigerator is detachably attached to a refrigerant container, containing a refrigerant gas condensed by the cooling stage, of a cooling system. In particular the present invention relates to a method for attaching a refrigerator and an attachment device thereof, which is suitably applicable to a cooling system for cooling power equipment using high-temperature superconductors with a plurality of refrigerators, and in which only a broken refrigerator is exchangeable without stopping the operation of the cooling system, namely without stopping the operation of the other correctly functioning refrigerators, and with keeping cooling an object to be cooled.

BACKGROUND ART

Power equipment using high-temperature superconductors such as a generator, a motor, a potential transformer, and the like operates under a temperature of approximately 30K. Since high refrigeration capacity is necessary to cool the power equipment, a cooling system having a plurality of (approximately five) Gifford-McMahon (GM) refrigerators or pulse tube refrigerators (hereinafter simply called "refrigerators," except in necessary) is used.

To stably operate the power equipment for a long term, the cooling system for cooling the equipment also has to stably operate for a long term. Accordingly, when the refrigeration capacity decreases due to the deterioration or breakdown of the refrigerator installed in the cooling system, it is preferable that the refrigerator can be exchanged.

FIG. 1 shows an overview of an ordinary cooling system. The cooling system adopts an indirect cooling method, in which when an object 10 to be cooled (for example, power equipment using high-temperature superconductors, for example, a rotor of a generator) is cooled to approximately 30K in the vicinity of which neon liquefies, a neon gas used as a refrigerant gas is once liquefied and retained in a liquefied neon container 12 to cool a helium gas circulating through the object 10 to be cooled in pipes 20. The helium gas circulating through the pipes 20 is sent out by a helium gas circulating pump 22 at ambient temperature, and is cooled by heat exchange with the helium gas returning through a first heat exchanger 24. Then, in a second heat exchanger 26, the helium gas is further cooled to approximately 30K by the liquefied neon retained in the liquefied neon container 12. After passing through a third heat exchanger 28 to cool the object 10 to be cooled, the helium gas gets into the first heat exchanger 24 in which the temperature increases to ambient temperature, and then returns to the circulating pump 22.

A cryostat 30 of the cooling system as a vacuum insulation container is provided with refrigerator attachment sleeves 32 into which a cylinder 44 of a plurality (two in the drawing) of refrigerators 40 and 42, provided to obtain high refrigeration capacity, is just fitted. Though the two refrigerators are provided in the drawing, the number of the refrigerators is changeable to one or more than three.

A refrigerator attachment flange 46, for attaching the refrigerators 40 and 42 to the cryostat 30, is provided with a seal O-ring 48 for the purpose of preventing the neon gas from leaking outside, and preventing air from getting inside.

The O-ring is provided in the flange 46 of the refrigerator in the drawing, but may be provided in the cryostat 30. A member for sealing is not limited to the O-ring, as long as the member can seal the gas.

A plurality of (two in the drawing) pipes 14 provided in the liquefied neon container 12 are connected to the refrigerator attachment sleeves 32 disposed above them. The internal diameter of the pipe 14 does not interfere with the circulation of the neon gas.

Since the neon gas is sealed in the liquefied neon container 12, the temperature of a low-temperature cooling stage 50 of the refrigerator (a second cooling stage, hereinafter simply called "cooling stage") decreases to a condensing temperature (a liquefaction temperature) of neon when the refrigerator operates, so that the neon gas condensing and dropping is retained in the container 12 disposed beneath. A low-temperature portion of 30K which has to be securely insulated from heat is generally disposed inside the vacuum insulation container (the cryostat 30 in the drawing). Incidentally, a vacuum exhaust system is omitted in the drawing.

In the drawing, reference numeral 52 is a compressor of the refrigerator.

Taking a case where one of the refrigerators deteriorates or breaks down due to some reason. In this case, in an ordinary cooling system, the refrigerator deteriorated or broken down in performance cannot be exchanged without stopping the operation of the cooling system to increase the temperature of the whole cooling system. This is because when the refrigerator is detached for exchange under operating condition of the cooling system (the other normal refrigerators keep operating without recovering the neon gas), the neon gas is lost (leaks) from the open container 12 for sealing the neon gas, and air and moisture getting into the container 12 increases temperature, so that it becomes impossible to keep cooling. Accordingly, before the refrigerator is detached, the cooling system is stopped to recover the neon gas (a neon gas recovery system is omitted in FIG. 1) and the temperature of the system increases to ambient temperature.

Although, in Japanese Patent No. 3265139 and Japanese Patent Laid-Open Publication No. Hei. 9-113048, a heat switch for quick pre-cooling is disposed between a high-temperature cooling stage and a low-temperature cooling stage of a refrigerator cylinder, between an object to be cooled and a heat shield for covering a low-temperature portion, or between the object to be cooled and the refrigerator, the cooling system has only one refrigerator, so that it is never considered that one or some of the plurality of refrigerators is detached.

DISCLOSURE OF THE INVENTION

The present invention is devised to solve the foregoing problem, and an object of the present invention is to make it possible to exchange only a broken refrigerator without stopping the operation of a cooling system (without stopping the other correctly functioning refrigerators) and with keeping cooling a cooled object, when refrigeration capacity decreases in one of the refrigerators installed in the cooling system due to its deterioration or breakdown.

To achieve the above object, the present invention is configured such that, when attaching a refrigerator, a heat conduction member is inserted between a cooling stage of the refrigerator and a refrigerant container, containing a refrigerant gas condensed by the cooling stage, of a cooling system; and the cooling stage is brought into thermally contact with the refrigerant container, a heat pipe, or a heat shield plate via a low melting point metal held in the heat conduction member.

In the invention, the heat conduction member may be a partition member for partitioning off the cooling stage from the refrigerant container.

In the invention, the heat conduction member may be inserted between the cooling stage and the heat pipe.

In the invention, the heat conduction member may be inserted between the cooling stage and the heat shield plate.

In the invention, a temperature of the low melting point metal may be controlled to be constant at a melting temperature thereof, during the exchange of the refrigerator.

In the invention, the low melting point metal may be indium, low melting point solder, or wood metal.

In the invention, the refrigerator may be a GM refrigerator or a pulse tube refrigerator.

To achieve the above object, the present invention is an attachment device of a refrigerator for detachably attaching a cooling stage of the refrigerator to a refrigerant container of a cooling system for containing a refrigerant gas condensed by the cooling stage, and the attachment device comprises: a heat conduction member intervened between the cooling stage and the refrigerant container, the heat pipe or the heat shield plate; and a low melting point metal held in the heat conduction member, for the purpose of bringing the cooling stage into thermally contact with the refrigerant container.

In the invention, a condensing fin may be provided in the heat conduction member on a side of the refrigerant container or the heat shield plate.

In the invention, the attachment device may be provided with a pipe for connecting a refrigerator attachment sleeve containing the cooling stage, the low melting point metal, and the heat conduction member, to the refrigerant container or the heat shield plate, and the pipe has a length enough to allow heat conducted by a pipe wall and a refrigerant gas.

In the invention, the attachment device may further comprises: a heater for heating the partition member; and a temperature sensor for measuring a temperature of the heat conduction member.

In the invention, the heater and the temperature sensor may be detachable.

In the invention, the attachment device may further comprises temperature control means for keeping a temperature of the low melting point metal constant at a melting temperature thereof, during the exchange of the refrigerator.

The present invention is to provide power equipment having a refrigerator attached by the above attachment device.

BEST MODE FOR CARRYING OUT THE INVENTION

Embodiments of the present invention will be hereinafter described with reference to the drawings.

Figure 1:
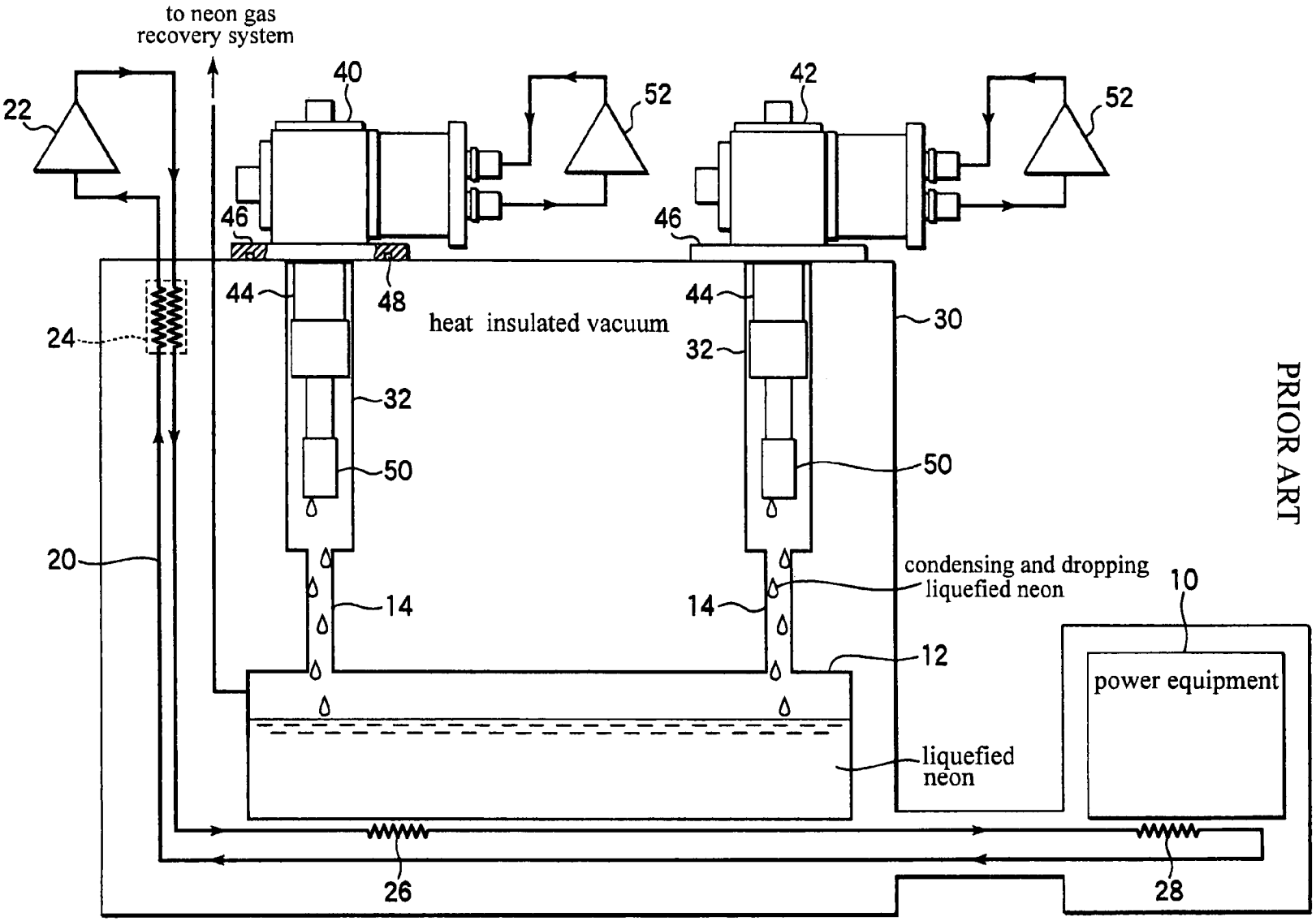
FIG.1 PRIOR ART
FIG. 1 is a sectional view showing the schematic configuration of a conventional cooling system.
Figure 2:
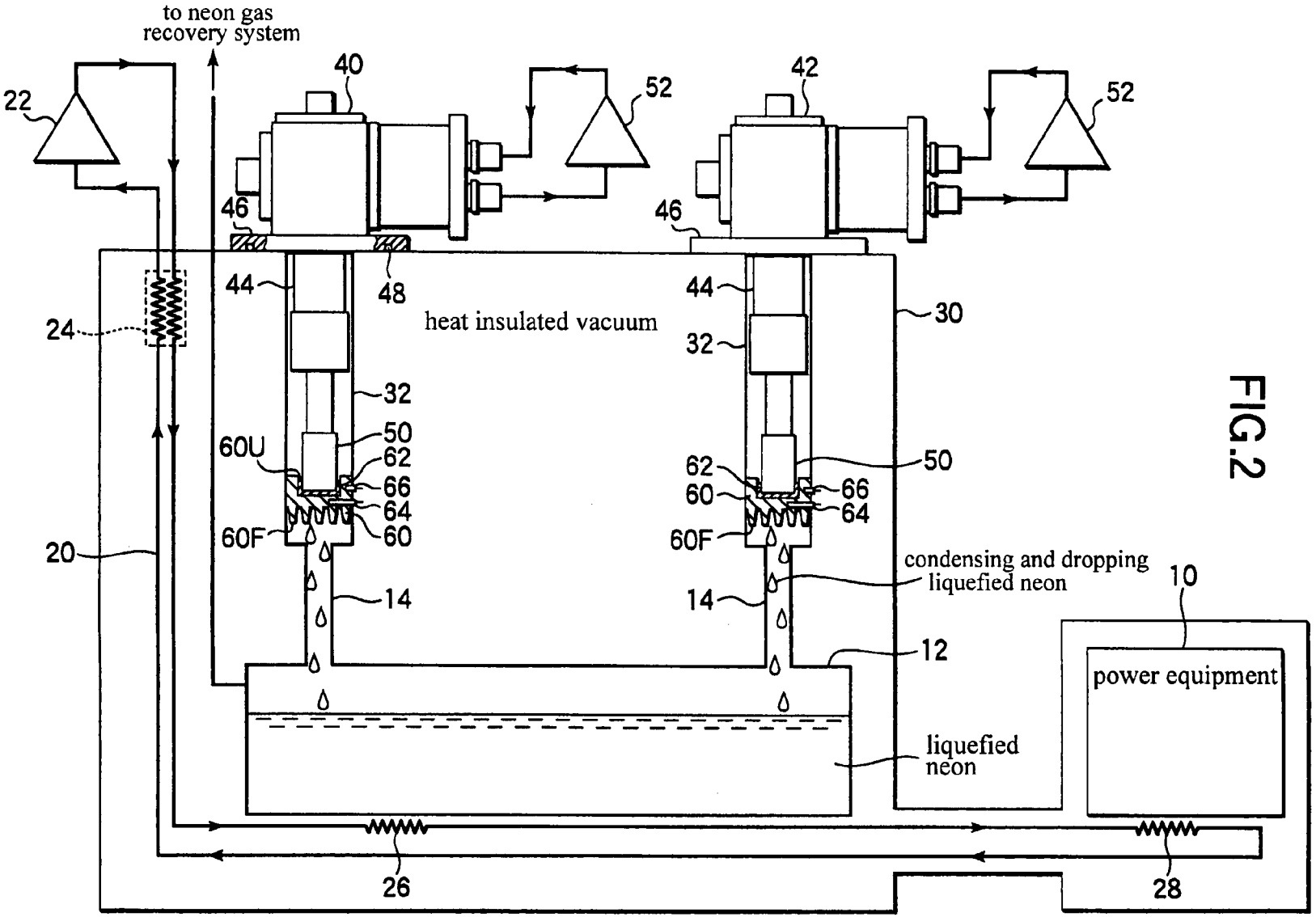
FIG. 2 is a sectional view showing the schematic configuration of a cooling system according to a first embodiment of the present invention.

According to a first embodiment of the present invention, in a cooling system similar to FIG. 1 as shown in FIG. 2, a cryostat 30 as a vacuum insulation container is provided with a plurality of refrigerator attachment sleeves 32 (hereinafter simply called as "sleeves") into which a cylinder 44 of each refrigerator is just fitted. A plurality of pipes 14 provided in a container 12 for retaining liquefied neon are connected to the respective sleeves 32 disposed above them. The sleeve 32 is made of a material having low thermal conductivity such as stainless steel and the like. A partition member 60 as a heat conduction member, made of a material having high thermal conductivity (for example, copper or a copper alloy), is disposed in a lower portion of the sleeve 32. A condensing fin 60F is disposed on the undersurface of the partition member 60. The condensing fin 60F may be omitted.

When the refrigerators 40 and 42 are fitted into the sleeves 32, the partition member 60 is disposed such that a cooling stage 50 at an end of the refrigerator comes into contact or leaves a narrow gap (it is preferable that the width of the gap is below 5 mm, in particular equal to or less than 1 mm.) with the partition member 60. The gap, illustrated in a large way in the drawing to intentionally show, is provided with a recess 60U into which a low melting point metal 62 (described later) pools. The partition member 60 is airtightly secured to the sleeve 32 with brazing, welding, bonding, or screwing.

The partition member 60 further includes an electric heater 64 and a temperature sensor 66.

A proper amount of the low melting point metal (for example, indium, low melting point solder, wood metal, mercury, or the like) is accumulated in the upper portion of the partition member 60 (the amount of the low melting point metal 62 is proper for the cooling stage 50 at the end of the refrigerator to satisfactorily establish good heat connections with the partition member 60). To establish good heat connections, it is preferable that the upper surface of the partition member 60 and the surface of the cooling stage 50 of the refrigerator are plated with the low melting point metal 62 in advance.

In assembling the cooling system, the electric heater 64 is energized to heat the partition member 60 so as to melt the low melting point metal 62, and the refrigerator 40, 42 is attached on the melted low melting point metal 62, so that it is possible to obtain good heat connection between the partition member 60 and the refrigerator 40, 42.

The temperature sensor 66 is used for measuring temperature to prevent overheating, when the energized electric heater 64 heats the partition member 50. It is preferable that a temperature controller is used for keeping the temperature of the partition member constant at a melting temperature of the low melting point metal 52.

When the refrigerators 40 and 42 are attached, since a space between the outside of the refrigerator cylinder 44 and the inside of the sleeve 32 is sealed with the O-ring 48 and the like so as to prevent air from getting through the refrigerator attachment flange 46, it is unnecessary to evacuate the space to a vacuum, or to fill the space with helium gas, neon gas or the like. Of course, the space may be evacuated to the vacuum, or filled with gas.

A lower end of each sleeve 32 is connected to the liquefied neon container 12 disposed below with the pipe 14 the size of which does not interfere with the circulation of the neon gas used for cooling. The pipe 14 has a proper length in a vertical direction so as not to conduct excessive heat to the liquefied neon container 12 disposed below (in the length, heat conducted by a pipe wall and gas becomes under an allowable value), when the partition member 60 is heated to the melting temperature of the low melting point metal 62 in order to detach the refrigerators 40 and 42.

The container 12 is filled with neon gas, (in a case where the object 10 to be cooled is cooled to approximately 30K). The cooling stage 50 of the refrigerator securely establishes heat connections to the partition member 60 via the low melting point metal 62 (for example, thermal resistance to heat conduction of approximately 100 W is only 1K or less).

When the operation of the refrigerator lowers the temperature of the partition member 60 to the condensing temperature of neon gas, neon gas starts liquefying and dropping from the undersurface of the partition member 60 (the condensing fin 60F). The liquefied and dropped neon is vaporized by heat exchange with helium gas for cooling the power equipment, and returns again to the undersurface of the partition member 60, so that the neon gas repeats the circulation of vaporization and condensation.

Each of the plurality of installed refrigerators 40 and 42 carries out the heat conduction (cooling) by means of the circulation of neon gas.

The same structure as in FIG. 1 is referred to the same reference numeral, and the detailed description thereof is omitted.

Now, taking a case where one of the refrigerators deteriorates or breaks down due to some reason. In stopping the operation of the broken refrigerator, the condensation of neon gas stops because the refrigeration capacity of the refrigerator is lost. Then, energizing the electric heater 64 heats the partition member 60 to melt the low melting point metal 62. The temperature sensor 66 is used for measuring temperature to prevent overheating, when the energized electric heater 64 heats the partition member 60. It is preferable that the temperature controller is used for keeping the temperature of the partition member 60 constant, at a melting temperature of the low melting point metal 62.

When the partition member 60 is heated to the melting temperature of the low melting point metal 62, the pipe 14, connecting the sleeve 32 for installing the refrigerator to the liquefied neon container 12, has a proper length in which heat conducted by the pipe wall and gas becomes under an allowable value, so that an amount of heat conduction to the liquefied neon container 12 is allowably small, even in this condition.

At this time, since the temperature of the cooling stage 50 of the deteriorated or broken refrigerator is increased to the melting temperature of the low melting point metal 62, it is possible to immediately detach the refrigerator. An upper area of the partition member 60 is warmer than ambient temperature, so that a problem of frosting does not occur.

Fitting a correctly functioning refrigerator into the sleeve 32, from which the broken refrigerator has been detached, the refrigerator immediately starts operating. Because the other correctly functioning refrigerators have kept operating and liquefying neon gas, the object 10 to be cooled continuously keeps cooled condition to low temperature.

Figure 3:
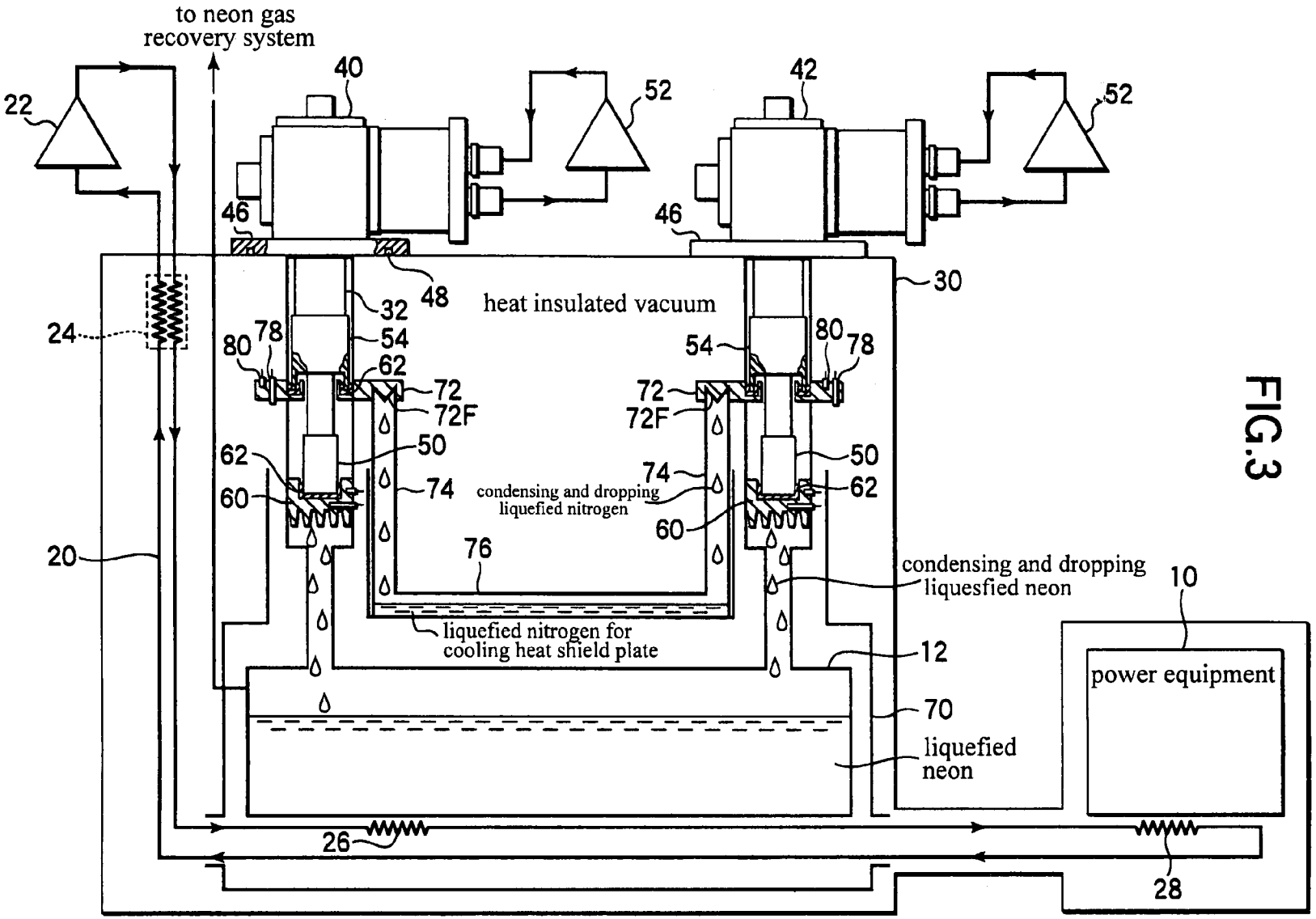
FIG. 3 is a sectional view showing the schematic configuration of a cooling system according to a second embodiment.

In the first embodiment, a heat shield plate is omitted because the refrigerators with relatively high refrigeration capacity are used to cool the power equipment to the relatively high temperature of 30K. However, if necessary, the same structure can be used for cooling the heat shield plate 70 as described as a second embodiment with reference to FIG. 3.

At this time, the sleeve 32 for installing the refrigerator is provided with a heat conduction plate 72 so as to further condense a nitrogen gas (or an argon gas) in a high-temperature stage (hereinafter called "a first stage") 54 of the refrigerator, and the heat conduction plate 72 has a pipe 74 in which the nitrogen gas circulates in a condensate state.

The heat conduction plate 72 is thermally connected to the first stage 54 of the refrigerator via the low melting point metal 62. A condensing fin 72F for promoting the condensation of the nitrogen gas is provided in the pipe 74 of the heat conduction plate 72. The condensing fin 72F may be omitted.

The pipe 74 for circulating the nitrogen gas in a condensate state is made of a material having low thermal conductivity (for example, stainless steel and the like). The inner diameter of the pipe 74 does not interfere with the circulation of the nitrogen gas. A liquefied nitrogen container 76 for cooling the heat shield plate 70 is provided under the pipe 74 (if there is no problem, it is possible to substitute a pipe for the container 76 to circulate the nitrogen gas). The liquefied nitrogen container 76 is made of a material having high thermal conductivity (copper or a copper alloy is preferable). The liquefied nitrogen container 76 is secured to the heat shield plate 70 by a method with sufficiently low thermal resistance (for example, brazing, soldering, bonding, screwing or the like).

The liquefied nitrogen container 76 is charged with the nitrogen gas. A nitrogen gas supply (or recover) unit, which is not illustrated in the drawing, may be provided if necessary.

In the drawing, reference numeral 78 denotes an electric heater for the first cooling stage 54 of the refrigerator, and reference numeral 80 denotes a temperature sensor thereof.

Since the other structure of the parts denoted by the same reference numbers is the same as the first embodiment, the detail description thereof is omitted.

In the second embodiment, nitrogen condensed by the heat conduction plate 72 cools the heat shield plate 70.

According to the second embodiment, in addition to the neon gas, the heat shield plate 70 is cooled by the method of the present invention.

In either of the first and second embodiments, the neon gas and nitrogen gas containers 12 and 76 are coupled to the plurality of (two) refrigerators 40 and 42, but each refrigerator may have an independent container. At this time, each area, in which the condensation and vaporization are repeated, has a structure what is called a heat pipe.

Figure 4:
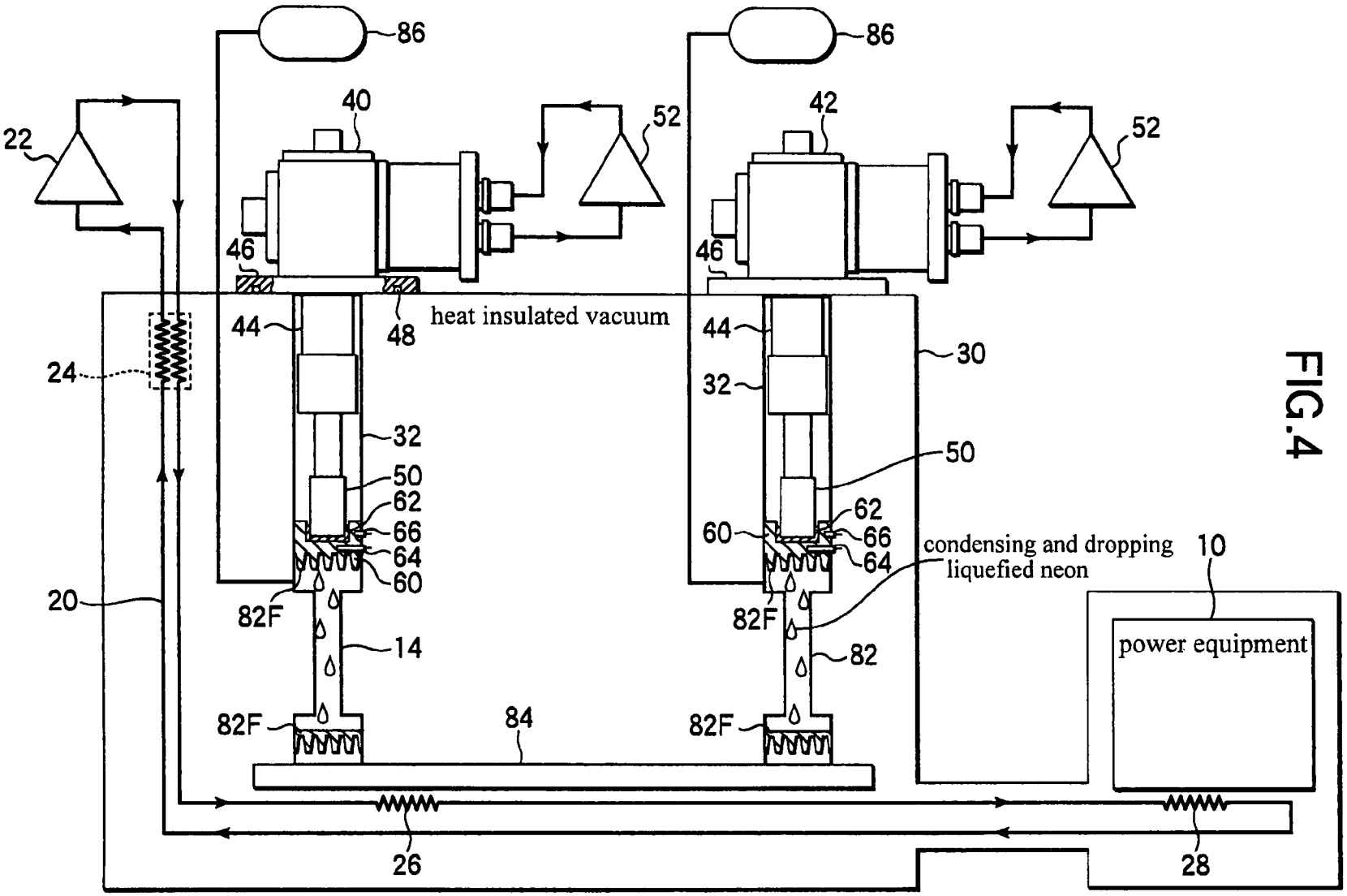
FIG. 4 is a sectional view showing the schematic configuration of a cooling system according to a third embodiment.

Then, a third embodiment of the present invention, in which the heat pipe is used for the heat conduction of each refrigerator, will be hereinafter described with reference to FIG. 4.

In this embodiment, a bottom end of each heat pipe 82 is connected to a common heat conduction member 84, and gas liquefied therein exchanges heat with a helium gas circulating through pipes 20.

In the drawing, reference numeral 86 denotes a neon gas supply and recovery tank. Generally the neon gas supply and recovery tank 86 is a tank which can retain a proper amount of gas, but a neon gas supply (or recovery) unit (not illustrated) may be installed outside in a case where an amount of neon gas inside the heat pipes 82 is short.

In the drawing, the upper and lower portions of the heat pipe 82 are large in diameter, but the diameter of the heat pipe 82 may be uniform, if admissible. In exchanging the refrigerator, the temperature of an upper partition member 60 has increased to the melting temperature of a low melting point metal 62. Accordingly, since a heat pipe wall and the gas inside the heat pipe, has temperature gradient, the larger the diameter of the pipe, the larger thermal load is applied to a low temperature portion. When the refrigerator operates to condense the inside gas, there is no temperature difference in the upper and lower portions of the heat pipe, so that heat loss does not occur in the heat pipe.

In the drawing, short heat conduction fins 82F (a long fin is meaningless because a heat transfer rate of condensation and vaporization is extremely high) are disposed inside the upper and lower portions of the heat pipe, but the fins may be omitted depending on an amount of heat conduction.

It is preferable that the heat conduction member 84 disposed under the heat pipe is made of copper, a copper alloy, aluminum, or an aluminum alloy.

In the drawing, the heat pipes 82 vertically extending downward are connected to the large heat conduction member 84, but the heat pipes 82 disposed in slanting directions may be connected to a relatively small heat conduction member 84. By doing so, in the case of indirect cooling as shown in the drawing, the temperature gradient decreases in the heat conduction member. In the case of directly cooling a large object to be cooled, on the other hand, the lower ends of the heat pipes are separately disposed to evenly cool the object to be cooled.

Figure 5:
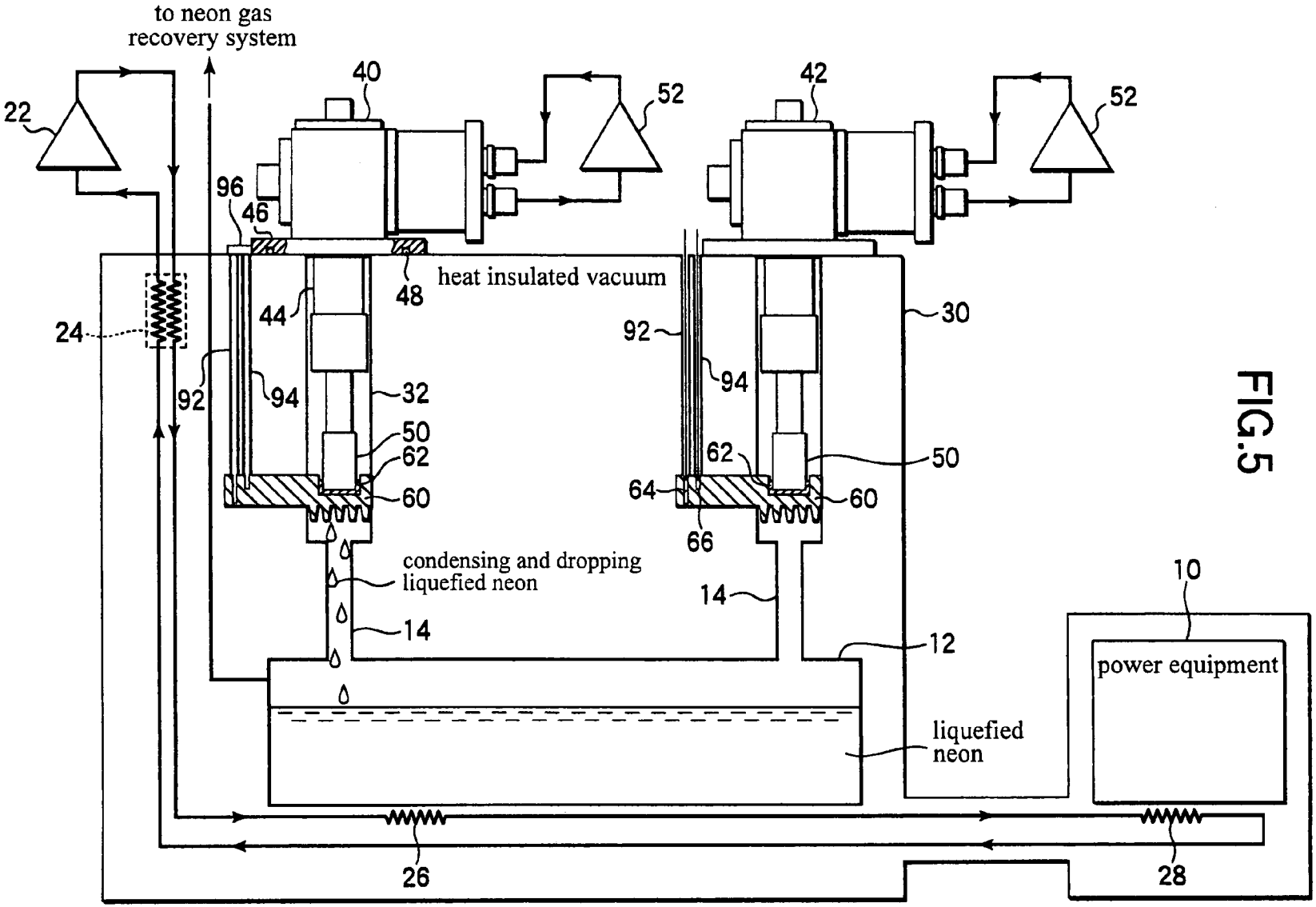
FIG. 5 is a sectional view showing the schematic configuration of a cooling system according to a fourth embodiment.

Referring to FIG. 5, a fourth embodiment of the present invention, in which an electric heater 64 and a temperature sensor 66 are attached afterward in attaching or detaching the refrigerators 40 and 42, will be hereinafter described in detail.

In a similar cooling system to the first embodiment, a refrigerator 42 illustrated on the right side of the drawing stops operating for attachment (or detachment). The drawing shows a situation in which the electric heater 64 and the temperature sensor 66 are inserted into a partition member 60 through pipes 92 and 94 in order to melt the low melting point metal 62.

The refrigerator 40 illustrated on the left side keeps operating to condense and liquefy neon.

At this time, the electric heater and the temperature sensor are detached, and a lid 96 covers the upper ends of the pipes 92 and 94 to prevent air from getting thereinto.

Figure 6:
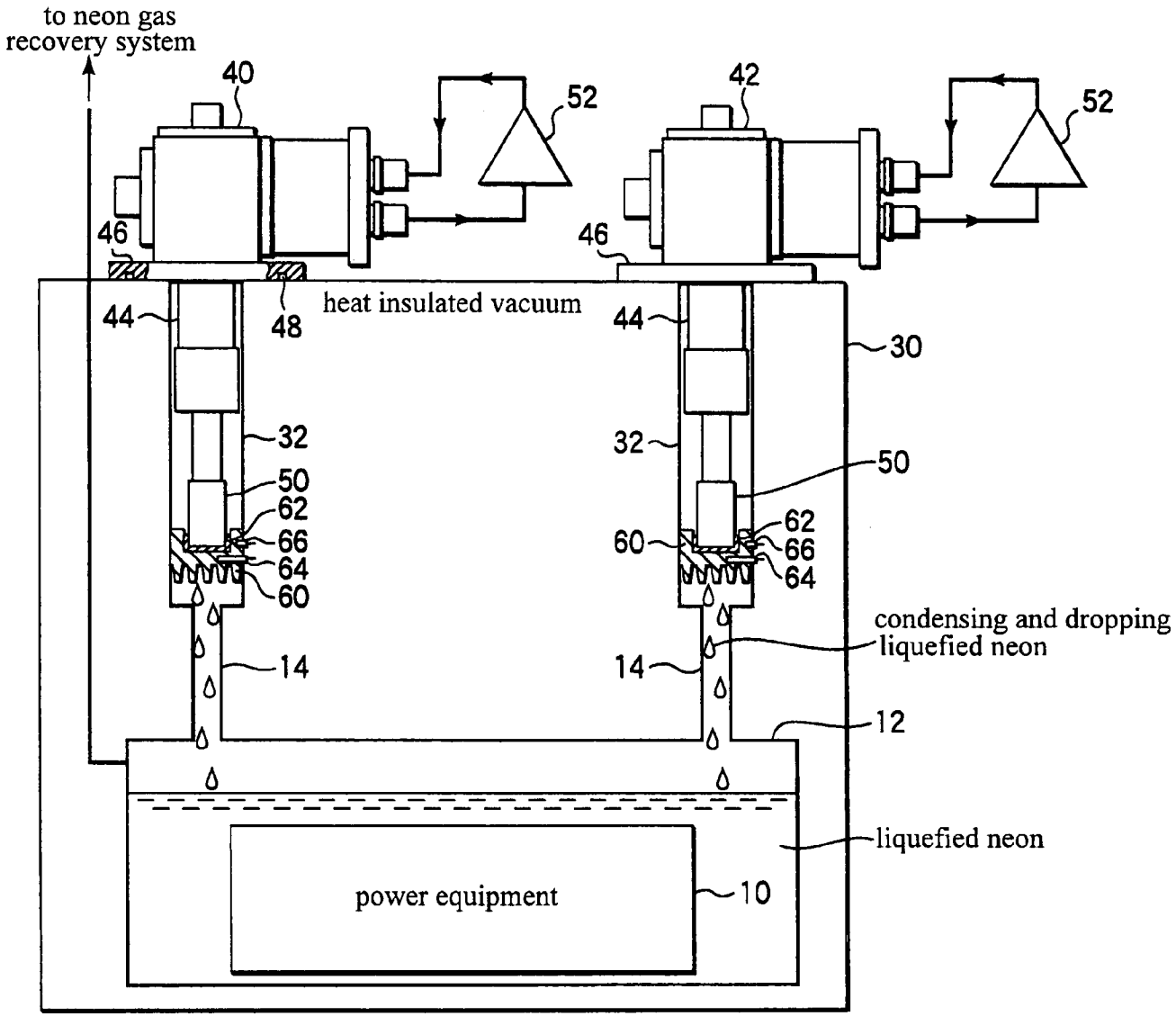
FIG. 6 is a sectional view showing the schematic configuration of a cooling system according to a fifth embodiment.

The foregoing description is in a case of indirect cooling method, but as described in a fifth embodiment with reference to FIG. 6, an object 10 to be cooled may be disposed in a liquefied neon container 12 in order to directly cool the object 10 to be cooled with liquefied neon gas.

In this case, it is unnecessary to provide a helium gas circulating pump, a heat exchanger, and the like disposed outside.

Figure 7:
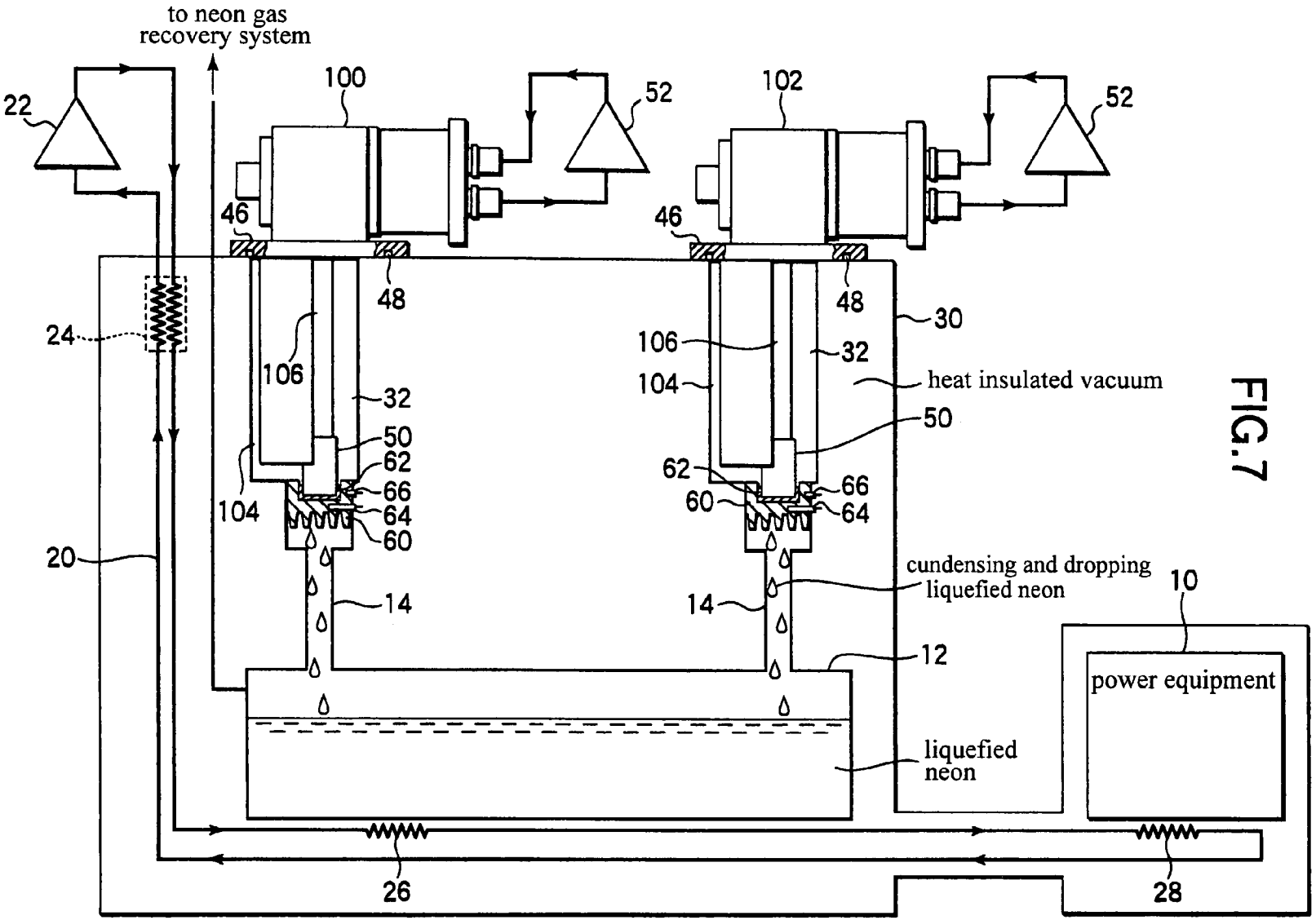
FIG. 7 is a sectional view showing the schematic configuration of a cooling system according to a sixth embodiment.

In the foregoing embodiments, a GM refrigerator is used as the refrigerator, but a type of refrigerator is not basically limited. Pulse tube refrigerators 100 and 102 may be used, as described in a sixth embodiment with reference to FIG. 7.

Since the pulse tube refrigerator is generally composed of a plurality of cylinders (a pipe 104 for charging a storage medium and an expansion tube 106), a refrigerator attachment sleeve 32 thereof becomes large in size, as compared with the case of GM refrigerator.

Though neon gas is used in the above embodiments due to a cooling temperature of 30K, an argon gas (90–140K), a nitrogen gas (70–120K), a hydrogen gas (14–30K), and a helium gas (5K) are available in accordance with a target cooling temperature.

In the above embodiments, the present invention is applied to the cooling of power equipment using high-temperature superconductors. However, an object to be cooled is not limited thereto, on the contrary, the present invention is equally applicable to a cryopump, a superconducting magnet, a material property measuring device, and the like.

INDUSTRIAL APPLICABILITY

In the conventional method, it is necessary to stop the cooling system and increase the temperature of the whole cooling system to ambient temperature by recovering a refrigerant gas, before detaching the refrigerator. Accordingly, an object to be cooled (for example, power equipment) cannot operate during exchange of the refrigerator, or before cooling the cooling system again to a predetermined temperature. According to the present invention, on the other hand, it is possible to exchange a broken refrigerator without stopping cooling the object to be cooled. Thermal resistance between a partition member and a cooling stage of the refrigerator is small, because it corresponds to the resistance of thin low melting point metal, so that temperature difference becomes extremely small in spite of a large amount of heat conduction (refrigeration capacity).

Especially in a case where an electric heater and a temperature sensor are attached to the partition member, since the heater heats the low melting point metal to melting temperature, the whole area involved in exchange is heated to ambient temperature or slightly higher, so that it is possible to easily attach and detach the refrigerator without troublesome operations such as anti-frosting and the like. If a temperature controller keeps the temperature of the partition member constant at a melting temperature of the low melting point metal, this attachment and detachment operation further becomes easy.

The invention claimed is:

1. A method for attaching a refrigerator comprising the steps of:

inserting a heat conduction member between a cooling stage of the refrigerator and a refrigerant container of a cooling system for containing a refrigerant gas condensed by the cooling stage, a heat pipe, or a heat shield plate; and bringing the cooling stage into thermally contact with the refrigerant container, the heat pipe, or the heat shield plate via a low melting point metal held in the heat conduction member.

2. The method for attaching a refrigerator according to claim 1, wherein the heat conduction member is a partition member for partitioning off the cooling stage from the refrigerant container.

3. The method for attaching a refrigerator according to claim 1, wherein the heat conduction member is inserted between the cooling stage and the heat pipe.

4. The method for attaching a refrigerator according to claim 1, wherein the heat conduction member is inserted between the cooling stage and the heat shield plate.

5. The method according to any one of claims 1 to 4, wherein a temperature of the low melting point metal is controlled to be constant at a melting temperature of the low melting point metal, during the exchange of the refrigerator.

6. The method for attaching a refrigerator according to claim 1, wherein the low melting point metal is indium, low melting point solder, or wood metal.

7. The method for attaching a refrigerator according to claim 1, wherein the refrigerator is a GM refrigerator or a pulse tube refrigerator.

8. An attachment device of a refrigerator for detachably attaching a cooling stage of the refrigerator to a refrigerant container for containing a refrigerant gas condensed by the cooling stage, to a heat pipe, or to a heat shield plate, the attachment device comprising:

a heat conduction member inserted between the cooling stage and the refrigerant container, the heat pipe, or the heat shield plate; and a low melting point metal held in the heat conduction member, the low melting point metal bringing the cooling stage into thermally contact with the refrigerant container.

9. The attachment device of a refrigerator according to claim 8, wherein a condensing fin is provided in the heat conduction member on a side of the refrigerant container or the heat shield plate.

10. The attachment device of a refrigerator according to claim 8 further comprising:

a pipe for connecting a refrigerator attachment sleeve containing the cooling stage, the low melting point metal, and the heat conduction member to the refrigerant container or the heat shield plate, the pipe having a length enough to allow heat conducted by a pipe wall and a refrigerant gas.

11. The attachment device of a refrigerator according to claim 8 further comprising:

a heater for heating the heat conduction member; and a temperature sensor for measuring a temperature of the heat conduction member.

12. The attachment device of a refrigerator according to claim 11, wherein the heater and the temperature sensor are detachable.

13. The attachment device of a refrigerator according to claim 8 further comprising:

temperature control means for keeping a temperature of the low melting point metal constant at a melting temperature of the low melting point metal, during the exchange of the refrigerator.

* * * * *